US005251673A

United States Patent [19]

Adachi et al.

[11] Patent Number: 5,251,673

[45] Date of Patent: Oct. 12, 1993

[54] WEFT SENSING IMAGING SYSTEM FOR WEAVING MACHINE

[75] Inventors: Masahiro Adachi; Keizo Shizuka; Eiji Shigeyoshi, all of Tokyo, Japan

[73] Assignee: Nissan Motor Co., Ltd., Yokohama, Japan

[21] Appl. No.: 813,679

[22] Filed: Dec. 26, 1991

[30] Foreign Application Priority Data

Dec. 28, 1990 [JP] Japan ..... 2-408880
Dec. 28, 1990 [JP] Japan ..... 2-409024

[51] Int. Cl.[5] ..... D03D 49/00; D03D 51/34

[52] U.S. Cl. ..... 139/370.1; 139/1 R; 139/192; 139/431; 382/1; 364/921.1; 356/431; 358/101

[58] Field of Search ..... 26/51.5; 382/1; 364/921.1; 139/1 R, 370.1, 192, 435.5; 358/101; 356/431, 429, 430

[56] References Cited

U.S. PATENT DOCUMENTS 4,158,372 6/1979 Van Dijck ..... 139/370.1
4,582,095 4/1986 Kronholm ..... 139/1 R
4,791,481 12/1988 Verdiere et al. ..... 139/1 R X

FOREIGN PATENT DOCUMENTS 60-185846 9/1985 Japan ..... 139/370.1
61-11192 1/1987 Japan .
62-263353 11/1987 Japan ..... 139/370.1
63-275755 11/1988 Japan .

*Primary Examiner*—Peter Nerbun
*Attorney, Agent, or Firm*—Foley & Lardner

[57] ABSTRACT

A weft sensing system for a weaving machine such as an air jet loom or a water jet loom includes an image sensor camera for scanning at least a line passing through a weft insertion path to detect an abnormal weft insertion. The image sensor camera is set to perform one or more scans in each pick, and connected with an image processor which monitors the size or position of an image of a weft yarn. Preferably, the image sensor camera is positioned on the front side of the reed.

47 Claims, 13 Drawing Sheets

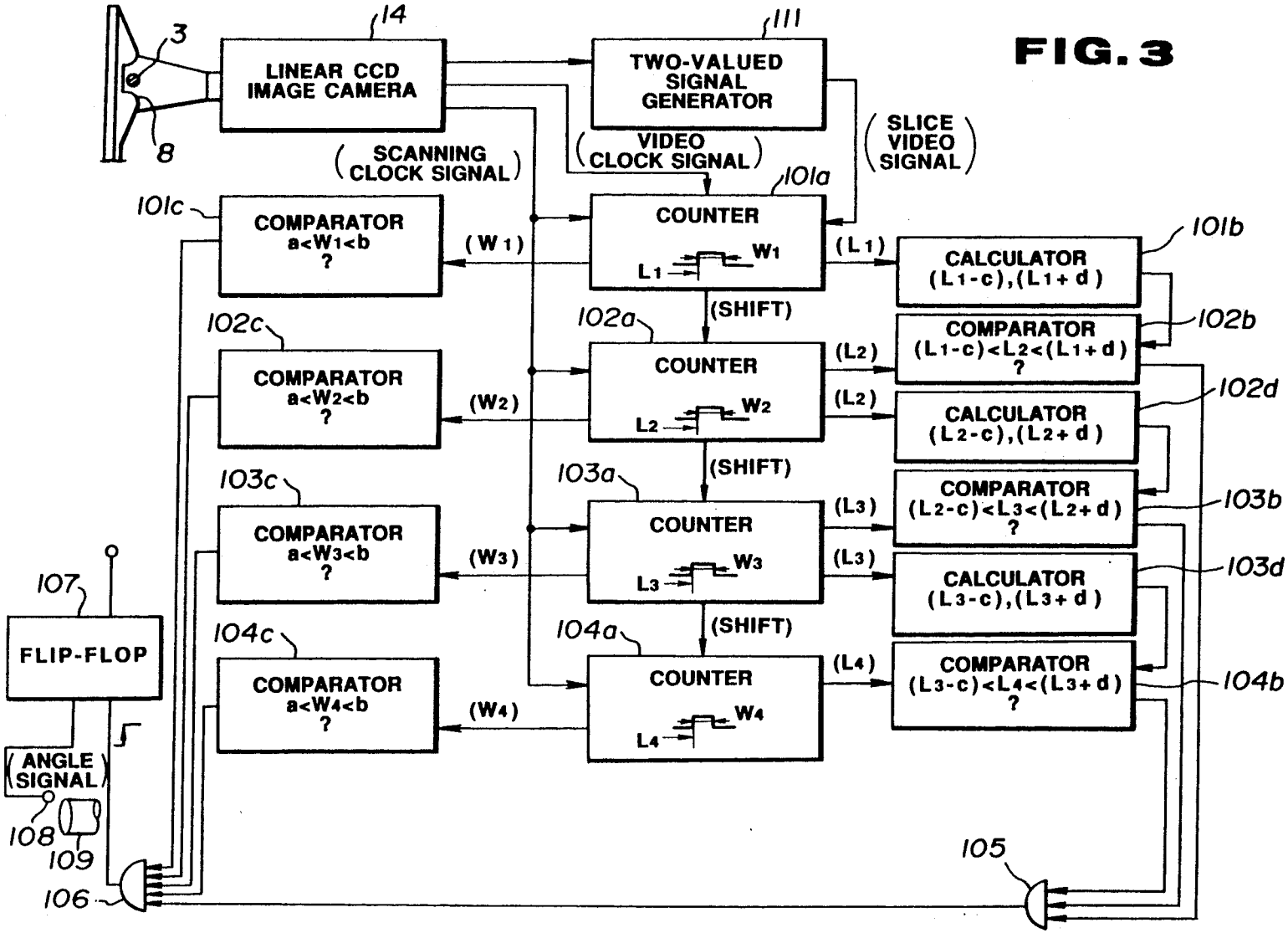
FIG. 3
TWO-VALUED SIGNAL GENERATOR
111
SLICE VIDEO SIGNAL
VIDEO CLOCK SIGNAL
LINEAR CCD IMAGE CAMERA
14
SCANNING CLOCK SIGNAL
3
8
COUNTER
101a
102a
103a
104a
(SHIFT)
(L1)
(L2)
(L3)
(L4)
(W1)
(W2)
(W3)
(W4)
COMPARATOR a<W1<b ?
COMPARATOR a<W2<b ?
COMPARATOR a<W3<b ?
COMPARATOR a<W4<b ?
101c
102c
103c
104c
CALCULATOR (L1-c),(L1+d)
COMPARATOR (L1-c)<L2<(L1+d) ?
CALCULATOR (L2-c),(L2+d)
COMPARATOR (L2-c)<L3<(L2+d) ?
CALCULATOR (L3-c),(L3+d)
COMPARATOR (L3-c)<L4<(L3+d) ?
101b
102b
102d
103b
103d
104b
105
106
FLIP-FLOP
107
ANGLE SIGNAL
108
109

WEFT SENSING IMAGING SYSTEM FOR WEAVING MACHINE

BACKGROUND OF THE INVENTION

The present invention relates to a weft sensing system for a weaving machine, and more specifically to a weft sensing system of an optical type.

Japanese Utility Model Provisional Publication No. 62-11192 shows an air jet loom equipped with an optical sensor unit including a prism, a light emitting device and a light sensitive device. The sensor unit is inserted in an interspace between two adjacent reed dents from the back side, and designed so that light is intercepted by a weft yarn when the weft yarn is correctly inserted in a warp shed, and reaches a preset goal of a weft flight path. This sensor unit, however, requires troublesome removal, reinstallment, and readjustment in case of warp exchange because the sensor unit is attached to the reed. Furthermore, this sensing unit must cover a relatively wide portion of the weft flight path to correctly detect the weft yarn. If the light emitting and sensing devices are placed on the front side of the reed, then the sensing accuracy becomes worse because the weft yarn occupies a very small portion in a relatively large sensing area.

Japanese Patent Provisional Publication No. 63-275755 shows an air jet loom equipped with a weft sensing system which can detect a broken pick. This sensing system, however, employs two optical sensing units which are attached to the reed at two separate positions. Therefore, this sensing system is complicated. Moreover, the positions of the two sensing units must be adjusted separately according to the kinds of thread and fabric.

SUMMARY OF THE INVENTION

It is an object of the present invention to provide a weft sensing system which can detect a weft yarn accurately.

It is another object of the present invention to provide a weft sensing system which is accurate, and exempt from troublesome and time-consuming operations.

It is still another object of the present invention to provide a weft sensing system which can discriminate between broken pick and normal pick with a single sensor unit.

According to the present invention, a weft sensing system for a weaving machine comprises an image sensor for detecting a weft yarn at a predetermined position in the weaving machine. The image sensor is aimed at a weft insertion path of the weaving machine along which the weft yarn moves, and arranged so that the image sensor scans at least along a direction which intersects the weft insertion path.

Preferably, the image sensor is placed on a cloth fell's side of a reed of the weaving machine, and there is further provided at least one light source.

The scan of the image sensor may be performed one time in each pick, or may be repeated a predetermined number of times in each pick.

In order to detect a broken pick, a half mirror (or partially reflecting mirror) is placed between the image sensor and the weft insertion path in such a manner as to enable the image sensor to monitor two different positions separated along the weft insertion path.

BRIEF DESCRIPTION OF THE DRAWINGS

FIG. 3 is a block diagram showing an image processing circuit employed in the first embodiment.

FIG. 8A is a side view, and FIG. 8B is a front view.

FIG. 18A is a side view, and FIG. 18B is a front view.

DETAILED DESCRIPTION OF THE INVENTION

A first embodiment of the present invention is shown in FIGS. 1~4.

Figure 1:
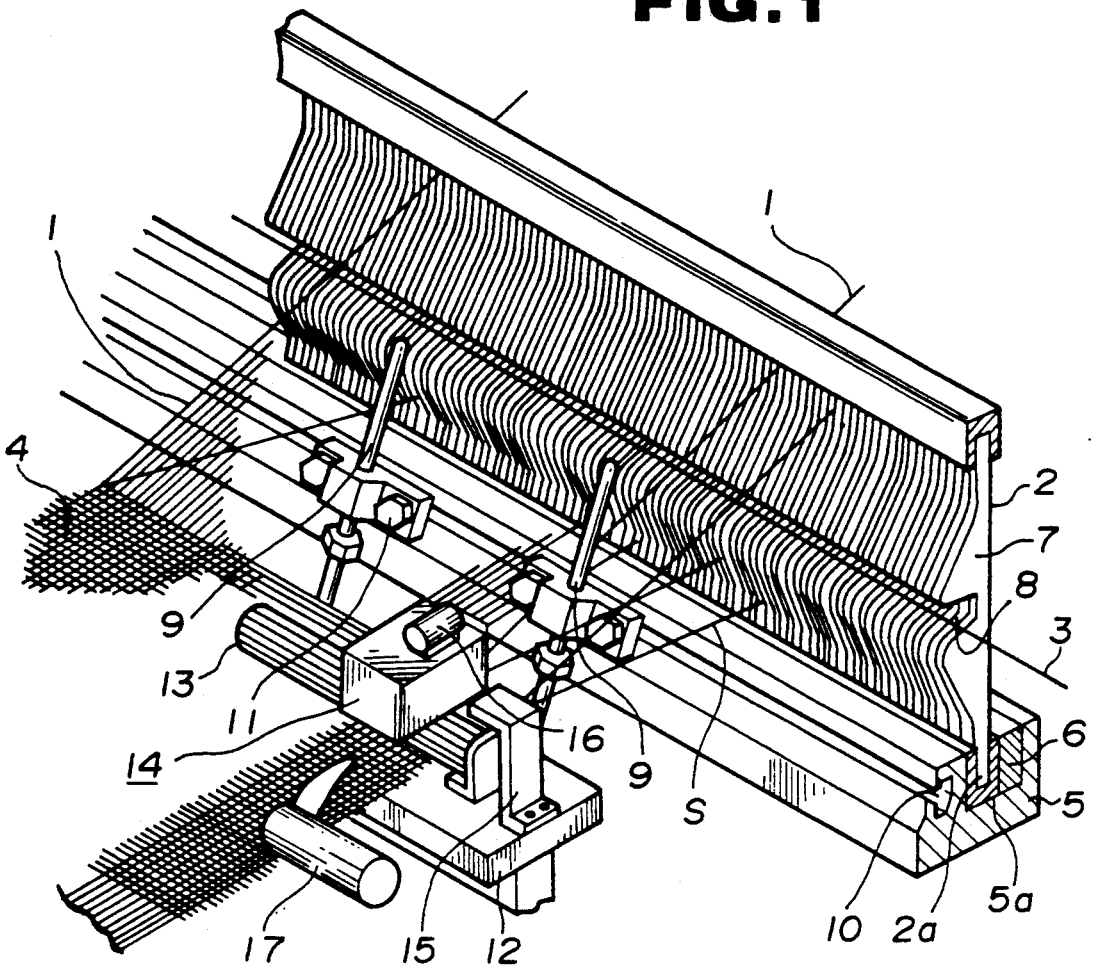
FIG. 1 is a perspective view showing a main portion of an air jet loom according to a first embodiment of the present invention.

A weaving machine of this embodiment is an air jet loom. As shown in FIG. 1, warp yarns 1 are drawn through a reed 2, and a weft yarn 3 is inserted transversely to produce a woven fabric 4. There is further provided at least one catch cord yarn S.

The reed 2 is fixed to a reed holder 5. The reed 2 has an upper frame member and a lower frame member 2a which is received in a groove 5a formed in the reed holder 5. A wedge member 6 is forcibly inserted in the groove 5a of the reed holder 5 to fasten the reed 2 to the reed holder 5. The reed holder 5 is swingable back and forth. The reed 2 further has a plurality of profiled reed dents 7 extending substantially vertically. Each profiled dent 7 has a bulge portion projecting toward the position of a cloth fell, and a recess which is formed at the apex of the bulge portion. The recess of each dent 7 opens toward the cloth fell position. The back side of each dent 7 is straight. Each dent 7 is shaped like a long plate, and has left and right flat side surfaces which are substantially parallel to the lengthwise direction of the warp yarns 1. The recesses of the profiled reed dents 7 are aligned to form a weft guide groove 8 defining a weft flight path for weft insertion.

Auxiliary nozzles 9 are arranged at predetermined intervals along the weft guide groove 8. Each auxiliary nozzle 9 is fixed to the reed holder 5 by one or more bolts 11 inserted in a T-shaped groove 10 which is formed in a front face of the reed holder 5 and which extends along the weft guide groove 8. Each auxiliary nozzle 9 ejects an auxiliary air jet obliquely toward the weft guide groove 8.

In this weaving machine, heald (or heddle) frames raises and lowers certain groups of alternate warp yarns to form a warp shed, and a main nozzle propels the weft yarn 3 into the warp shed by ejecting a main air jet. The auxiliary nozzles 9 produce the auxiliary air jets and give additional impetus to the flight of the weft yarn 3 ejected from the main nozzle. The weft inserting operation is finished when the forward end of the flying weft yarn passes a position of weft detection, and reaches an opening of the catch cord yarns S. Thereafter, the inserted weft yarn 3 is beaten up to the cloth fell by the reed 2. This weaving machine weaves the warp and weft threads into the fabric 4 by periodically repeating such a weaving cycle.

One temple 13 is fixed to a top stay 12. The woven fabric 4 advances while the temple arrangement pulls both sides of the fabric to keep the proper width of the fabric 4. The top stay 12 is stationary relative to the frame of the weaving machine. The top stay 12 extends substantially in parallel to the weft flight path.

An image sensor camera 14 is provided to detect an abnormal weft insertion. The image sensor camera 14 serves as a weft detecting apparatus or a weft feeler. The image sensor camera 14 is located near the weft guide groove 8 of the reed 2 on an arrival side (or anti-nozzle side) of the weaving machine. In the machine shown in FIG. 1, the main nozzle (not shown) is disposed on the left side of the machine, so that the leading end of each filling departs from the main nozzle on the left side and arrives at a predetermined goal position on the right side. In this embodiment, therefore, the arrival side is the right side.

Figure 2:
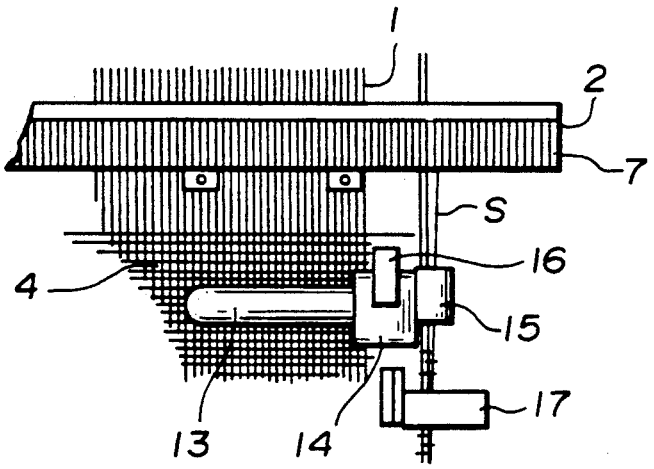
FIG. 2 is a plan view showing the portion of the loom shown in FIG. 1.

In this embodiment, the image sensor camera 14 is fixed to the top stay 12 through a bracket 15. The top stay 12 is located on a cloth fell's side (or front side) of the reed 2. The image sensor 14 of the first embodiment, therefore, is located on the cloth fell's side of the reed 2. The image sensor camera 14 is directed toward the weft guide groove 8, and arranged to scan along at least one line lying in an imaginary intersecting plane which intersects the weft inserting path. The line of sight (or aiming direction) of the image sensor camera 14 also lies in the imaginary intersecting plane. In this embodiment, the imaginary intersecting plane intersects the weft inserting path and the weft guide passage 8 substantially at right angles. The image sensor camera 14 is located between the collection of the parallel warp threads 1, and the catch cord S, as shown in FIG. 2.

The bracket 15 has a lower flange which is fixed to the top stay 12 near a mounting portion of the right side temple 13, a vertical portion extending upwardly from the lower flange, and an upper portion projecting toward the main nozzle, from the top of the vertical portion. A casing of the image sensor camera 14 is fixed to the top surface of the upper portion of the bracket 15. As shown in FIG. 1, the camera casing is shaped like a rectangular parallelepiped. The adjustment of position of the image sensor camera 14 is automatically performed by adjusting the position of the temple 13.

The image sensor camera 14 has an image sensor 14a. In this embodiment, the image sensor 14a is a solid state image sensor of a CCD type or a MOS (metal-oxide-semiconductor) type. The solid state image sensor includes an array of photoelectric transducing elements such as photodiodes. The array may be a two-dimensional array (as in an area sensor), or may be a linear array (as in a linear sensor). In this embodiment, the image sensor 14a is a linear image sensor. The photoelectric elements (imaging elements) are arranged in a straight line.

The image sensor camera 14 further includes an optical system comprising at least one optical lens 14b. The optical lens is oriented so that the sight is set on a predetermined sensing section of the weft guide groove 8, and an image is formed on the image sensor 14a. In this embodiment, the camera casing, and the bracket 15 and the temple 13 serve to position and orient the image sensor 14a and the optical lens 14b.

In accordance with a signal of a sensor drive circuit 14c, the image sensor 14a scans a predetermined narrow strip region which extends vertically and passes through the weft inserting path. This strip region may extend within a narrow interspace between two adjacent reed dents 7, or may extend along the front face of a predetermined one of the reed dents 7. That is, the camera 14 is aimed at the interspace of two adjacent reed dents 7, or the front face of one reed dent 7. Thus, the image sensor 14a is operated so that the target spot of observation sweeps along a vertical line segment which defines a field of view of the image sensor camera 14. A voltage signal is obtained from the image sensor 14a. It is possible to detect the existence or nonexistence of the weft yarn by monitoring this voltage signal.

Figure 4:
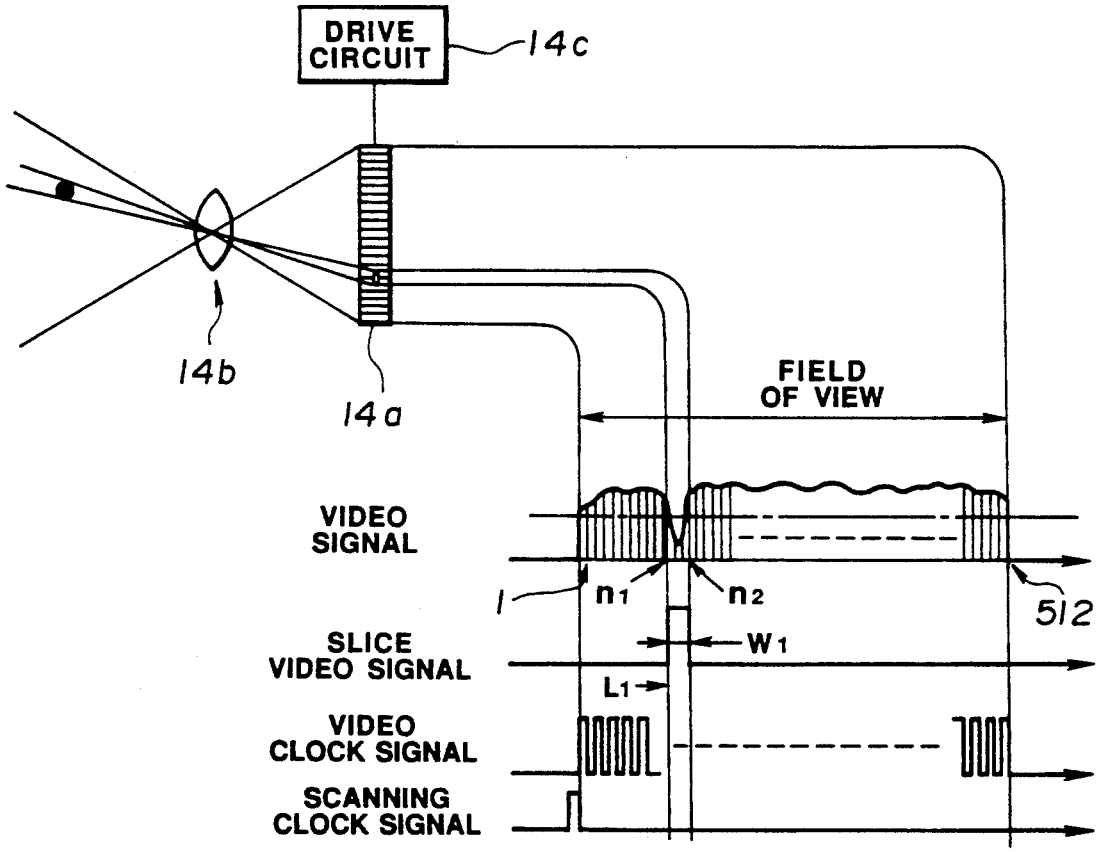
FIG. 4 is a schematic view for showing an output voltage signal of an image sensor and other signals appearing in the circuit of FIG. 3.

The image sensor 14a produces a video signal (or image signal) as shown in FIG. 4. In this embodiment, the video signal is in the form of a series of discrete quantities each of which is determined by a unique one of the photosensitive elements in the row (linear array). Each element receives light from a unique one of spots (or elemental areas) which are vertically arranged in the above-mentioned strip region, and produces an elemental electric signal (corresponding to a pixel). In each sweep of the scanning operation (i.e. each scan), these signals of the elements are delivered one by one in the form of the video signal. In this example, the photosensitive elements in the linear array are 512 in number, and the vide signal includes 512 pulses (or 512 bits).

In general, the flight of the weft yarn in each pick starts at or near a machine main shaft angle of 90 degrees, and reaches the weft sensing position at or near 240°. Therefore, the image sensor 14*a* is set to start the scanning operation when the main shaft reaches a preset angle close to 240°.

FIG. 3 shows an image signal processing circuit for processing the video signal of the image sensor 14*a*. The processing circuit may be a combination of circuits or may be a programmed computer.

The image sensor camera 14 of this embodiment is a linear CCD (Charge Coupled Device) image sensor camera. This image camera 14 has an external mode (an externally synchronized scanning mode) in which only one scanning sweep is performed in response to an external signal inputted to the camera from the outside, and an internal mode (an internal self scanning mode) in which an scanning signal is automatically produced within the camera 14, and the scanning operation is performed continuously. In this example, the internal scanning mode is selected.

A two-valued signal generating circuit 111 receives the video signal from the image camera 14, and produces a slice video signal which assumes one of two different values often symbolized as 1 and 0. In the slice video signal of the example shown in FIG. 4, there is one rectangular pulse representing the weft yarn. The width W1 of the rectangular pulse (i.e. the pulse duration) represents the width (or size) of the weft yarn, and the position L1 of the leading edge of the rectangular pulse represents the position of the weft yarn in the field of view. In this embodiment, the leading edge position L1 represents the height of the flying weft yarn because the scanning line is vertical.

The slice video signal is delivered from the two-valued signal generating circuit 111 to an image measuring counter circuit 101*a*. In addition to the slice video signal, the image measuring counter circuit 101*a* receives video clock signal and scanning clock signal from the image sensor camera 14. The image measuring counter circuit 101*a* measures the width W1 and the leading edge position L1 of the rectangular pulse of the slice video signal by counting clock pulses of the video clock signal, and produces a first width signal representing the width W1 and a first position signal representing the leading edge position L1.

A first calculating circuit 101*b* receives the first position signal from the image measuring counter circuit 101*a*, and produces a difference signal representing a result (L1−c) of subtraction of a predetermined constant c from the leading edge position L1, and a sum signal representing a result (L1+d) of addition of predetermined constant d to the width L1.

A first width (size) comparator circuit 101*c* receives the first width signal from the image measuring counter circuit 101*a*, and determines whether $a<W1<b$, by comparing the width (size) W1 with each of predetermined constants a and b. The first width comparator circuit 101*c* produces an affirmative signal if the first width W1 is greater than a, and smaller than b.

A first binary counter circuit (or register circuit) 102*a* is connected with the image measuring counter circuit 101*a*. Data items are shifted from the measuring counter circuit 101*a* to the first binary counter circuit 102*a* each time a scan pulse of the scanning clock signal is produced. Therefore, the first binary counter (or register) circuit 102*a* stores a second most recent thread width W2 and a second most recent thread position L2 which were determined from the slice video signal obtained in the previous scanning cycle. The first binary counter circuit 102*a* is connected with the image sensor camera 14 so that the scanning clock signal is inputted to the first binary counter circuit 102*a*.

A first position comparator circuit 102*b* receives signals from the first calculating circuit 101*b* and the first binary counter circuit 102*b*, and determines whether $(L1-c)<L2<(L1+d)$, or not. Thus, the position comparator circuit 102*b* checks whether the position L2 of the weft yarn detected in the previous scanning cycle is within a predetermined range around the current position L1 detected in the current cycle (i.e. the current scan).

A second calculating circuit 102*d* is connected with the first binary counter circuit 102*a*, and designed to produce a second difference signal representing a result (L2−c) of subtraction of the predetermined constant c from the second most recent position L2, and a second sum signal representing a result (L2+d) of addition of the constant d to the second most recent position L2.

A second width (size) comparator circuit 102*c* receives the signal of the second most recent width W2 from the first binary counter circuit 102*a*, and determines whether $a<W2<b$. The second width comparator circuit 102*c* produces an affirmative (YES) signal when the second most recent width W2 obtained in the previous scanning cycle is greater than the constant a and at the same time smaller than the constant b.

A second binary counter circuit (or a register circuit) 103*a* is connected with the first binary counter circuit 102*a*. The second binary counter circuit 103*a* has the same construction as the first binary counter circuit 102*a*. The data items stored in the first binary counter circuit 102*a* are shifted to the second binary counter circuit 103*a* in response to each scan pulse of the scanning clock signal of the camera 14. Therefore, the second binary counter circuit 103*a* retains the third most recent width W3 and the third most recent position L3 which were obtained in the third most recent scanning cycle. Like the first binary counter circuit 102*a*, the second binary counter circuit 103*a* is connected with each of a second position comparator circuit 103*b* similar to the first position comparator circuit 102*b*, a third width comparator circuit 103*c* similar to the second width comparator circuit 102*c*, and a third calculating circuit 103*d* similar to the second calculating circuit 102*d*.

A third binary counter circuit (or a register circuit) 104*a* is connected with the second binary counter circuit 103*a*, and arranged to retain the fourth most recent width W4 and the fourth most recent position L4 which were obtained in the fourth most recent scanning cycle. The third binary counter circuit 104*a* is connected with a third position comparator circuit 104*b* similar to the position comparator circuits 102*b* and 103*b*, and a fourth width comparator circuit 104*c* similar to the preceding width comparator circuits 101*c*, 102*c* and 103*c*. In this way, the video signal processing circuit of this embodiment stores, and checks the values of the width and position obtained in the four most recent consecutive scanning cycles.

The three position comparator circuits 102*b*, 103*b* and 104*b* are connected to an AND circuit 105. The four width comparator circuits 101*c*, 102*c*, 103*c* and 104*c* and the AND circuit 105 are connected to an AND circuit 106. The AND circuit 106 is connected to a flip-flop circuit 107. An angle sensor 108 for sensing the angular position of the main shaft 109 of the weaving machine is also connected to the flip-flop circuit 107.

The weft sensing system of the first embodiment works as follows:

On the occurrence of each scan pulse of the scanning clock signal, the image sensor 14*a* produces the video signal which, in this example, consists of the 512 elemental signals (pixels) of the 512 photosensitive elements in the linear array, and the two-valued signal generating circuit 111 produces the slice video signal as shown in FIG. 4. The image sensor camera 14 scans the scanned area vertically by delivering the 512 elemental signals one after another in each swing (or each scanning cycle). In this embodiment, the scanning operation is performed while the image sensor camera 14 is held stationary. If the weft yarn flying along the weft inserting path exists in the field of view of the camera 14, then one rectangular pulse is formed in the slice video signal, as shown in FIG. 4. This slice video signal is supplied to the image measuring counter circuit 101*a*, which counts the clock pulses to determined the width (or duration) W1 of the rectangular pulse, and the leading edge position L1 of the rectangular pulse of the slice video signal. In this embodiment, the position L1 is expressed in term of a length (or distance) of the leading edge of the rectangular pulse from one end of the field of view (or the left end of the video signal).

The first width comparator circuit 101*c* receives the current (or first most recent) width W1 of the image, and compares the current width W1 to determine whether the size of the image corresponds to the size of the weft yarn. The first width comparator circuit 101 produces the affirmative answer when the weft yarn is detected by the image sensor 14*a*, and a negative answer if the weft yarn does not exist in the field of view.

The scan pulse of the scanning clock signal is inputted from the image sensor camera 14 to each of the counter circuits 101*a*, 102*a*, 103*a* and 104*a*. Each scan pulse is used not only to initiate the scanning operation, but also to cause shifting of the data. In response to the scan pulse, the data is shifted from each counter circuit to the next counter circuit. The contents in the last counter circuit 104*a* are deleted. The counter circuit 101*a* stores the first most recent data obtained in the first most recent scan, the counter circuit 102*a* stores the second most recent data of the second most recent scan, and so on.

The width comparator circuits 101*c*, 102*c*, 103*c* and 104*c* check the four most recent values of the width of the image, respectively. The position comparator circuits 102*b*, 103*b* and 104*b* check changes of the position of the image during the four consecutive scans. If the weft yarn is inserted correctly, the position of the image does not change abruptly.

When the answers of the width comparator circuits 101*c*~104*c*, and the position comparator circuits 102*b*, 103*b* and 104*b* are all affirmative, then the video signal processing circuit of the first embodiment judges that the weft insertion to be in order, and keeps the weaving machine in the normal operation. If, however, any one or more of the comparator circuits produces the negative answer, then the processing circuit produces a stop signal to stop the weaving machine.

However, it is optional to arrange the video signal processing circuit so that the machine is stopped when and only when at least one of the width comparator circuits 101*c*, 102*c*, 103*c* and 104*c* produces the negative signal. In this case, the machine is not stopped, and instead an alarm signal is produced when at least one of the position comparators produces the negative signal.

As a light source, fluorescent lamp, halogen lamp, and gas laser device can be employed. In the first embodiment, a spot lamp 16 is fixedly mounted on the top of the image sensor camera 14, as shown in FIG. 1. The spot lamp 16 projects a beam of light to a relatively small area around a predetermined position on the weft guide groove 8. The light of the spot lamp 16 is reflected by one or more reed dents 7 in the illuminated area, and falls on the image sensor 14*a*. When the weft yarn 3 exists in the weft guide groove 8 within the illuminated area, then the light is intercepted by the weft yarn 3. It is preferable to connect a high frequency power supply to the fluorescent lamp if it is employed as the light source.

Figure 8A:
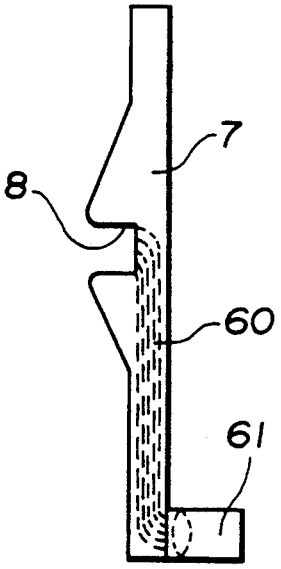
FIGS. 8A and 8B show a reed dent having optical fibers which can be used in the air jet loom of FIG. 1, and other air jet looms according to the present invention.
Figure 8B:
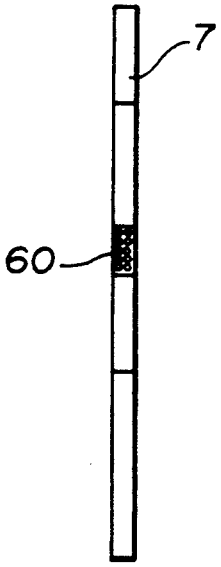

As shown in FIG. 8A and 8B, it is possible to employ the fiber optics, instead of the illumination using the spot lamp 16. optical fibers 60 and a light source 61 instead of the spot lamp 16. A bundle of parallel optical fibers (or a single optical fiber) 60 are embedded in at least one reed dent 7 as show in FIGS. 8A and 8B. A light source 61 is attached to the back side of the lower end portion of the reed dent 7. Light is transmitted from the light source 61 through the optical fibers 60 to the bottom of the recess of the reed dent 7, and projected from the bottom of the reed dent recess to the image sensor 14*a*.

Figure 5:
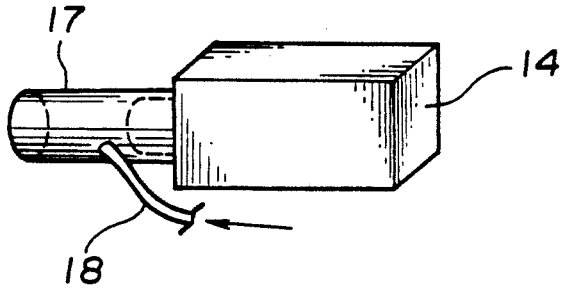
FIG. 5 is a perspective view showing a lens hood for an image sensor camera which can be used in the first embodiment.

A hood 17 shown in FIG. 5 can be employed for protecting the lens of the image sensor camera 14 from airborne lint (cotton fly). In the example shown in FIG. 5, a pipe 18 is connected to the hood 17. Purging air is introduced to the inside of the hood 17 through the pipe 16 to blow the lint and dust off from the interior space of the lens hood 17.

In the first embodiment, the image sensor camera 14 is disposed in front of the reed 2. Therefore, it is possible to exchange loom warps without removing the image sensor camera 14. The front side camera 14 of the first embodiment is advantageous in that the looming operation can be performed without need for troublesome adjustment of the camera position and orientation.

The weft detecting system of this embodiment is superior in sensing accuracy. The image sensor 14*a* scans the weft guide groove 8. Accordingly, the sensing area is narrow and the accuracy in detecting the weft yarn is high. Furthermore, a sampling time is short. The weft detecting system of this embodiment can accurately discriminate the flying weft yarn from other objects by employing a pattern recognition system. In the first embodiment, a plurality of scans are performed for each pick. However, it is optional to perform one scan in each pick.

Figure 6:
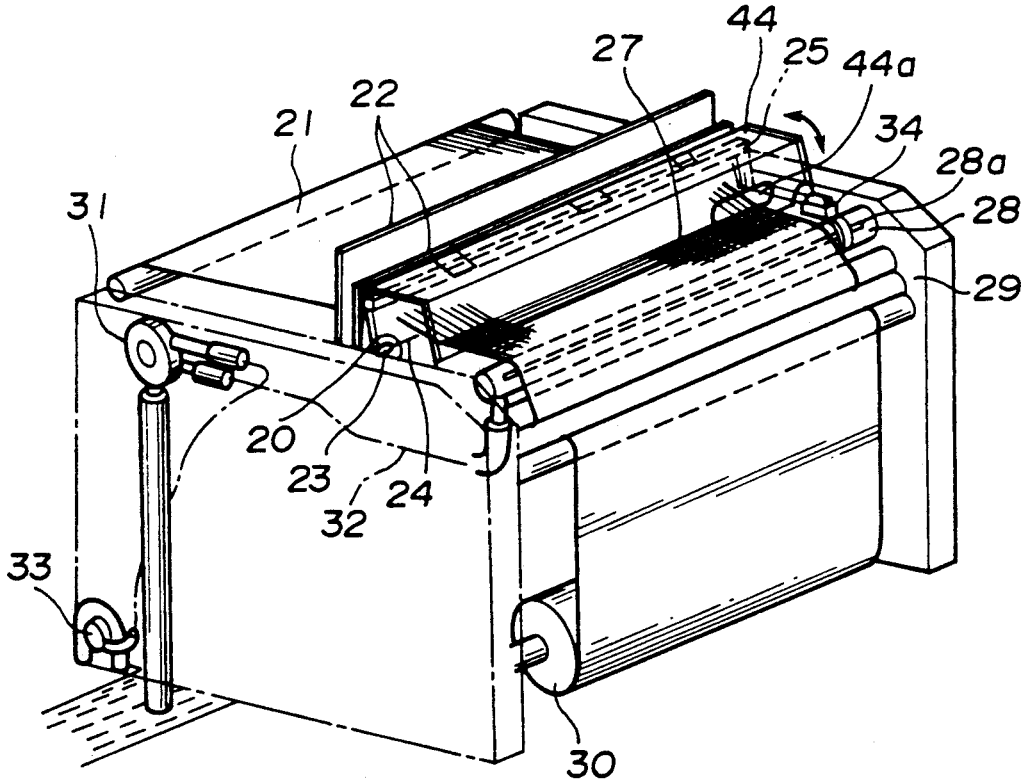
FIG. 6 is a perspective view showing a water jet loom according to a second embodiment of the present invention.

A second embodiment of the present invention is shown in FIG. 6. In the second embodiment, the machine is a water jet loom.

In the water jet loom shown in FIG. 6, a back roller 21 guides warp yarns 20 forward, healds 22 divides the warp yarns 20 into upper and lower groups to form a warp shed, a weft inserting nozzle 23 ejects a weft yarn 24 with water jet, and a reed 25 beats up the inserted weft yarn 24 into a fabric 27.

The woven fabric 27 is drawn through a suction cylindrical tube 28 to a filling density adjustment mechanism 29, and taken up by a cloth roller 30. The suction tube 28 is a dehydrator for removing water from the woven fabric 27 by aspiration. The suction tube 28 extends transversely from the left side to the right side of the machine, and has a slit 28*a* extending in the widthwise direction of the fabric. The slit 28*a* is covered by the advancing woven fabric 27. The interior cavity of the suction tube 28 is connected by a pipe system 32 through a gas-liquid separator 31 to a suction port of a blower 33.

Figure 7:
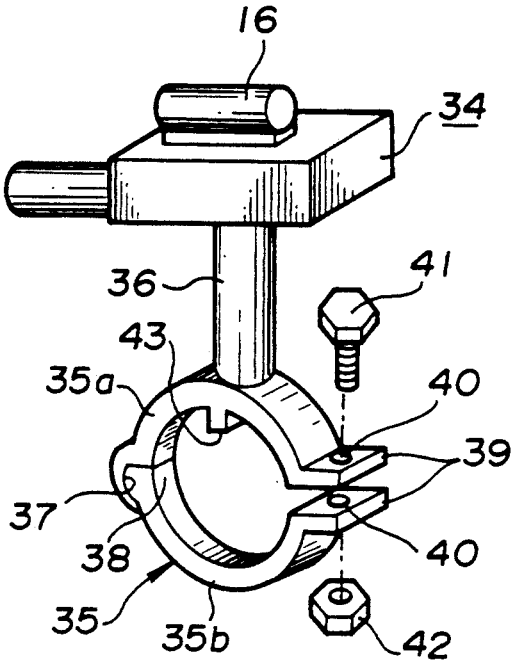
FIG. 7 is a perspective view of a structure supporting an image sensor camera used in the water jet loom shown in FIG. 6.

An image sensor camera 34 is disposed in front of the reed 25 on the arrival side (anti-nozzle side) of the weaving machine. In this embodiment, the image sensor camera 34 is fixedly mounted on the suction pipe 34 through a bracket 35 and a support rod 36 shown in FIG. 7.

The bracket 35 includes an upper semicircular member 35*a* and a lower semicircular member 35*b*. The upper semicircular member 35*a* has a first end which is formed with a recess, and a second end which is formed with a flange 39. The lower semicircular member 35*b* has a first end which is formed with a projection 38 and a second end which is formed with a flange 39. The first ends of the upper and lower members 39*a* and 39*b* are joined together by engaging the projection 38 in the recess 37. The flanges 40 of the upper and lower members 39*a* and 39*b* are fastened together by a bolt inserted through bolt holes 40 of the flanges 39, and a nut screwed on the bolt 41. The upper semicircular member 39*a* has an inward projection 43 projecting radially inwardly from the inside cylindrical surface of the upper member 39*a*.

The support rod 36 extends vertically, and has a lower end fixed to the top of the upper semicircular member 39*a*, and a upper end fixed to the bottom of the image sensor camera 34.

The upper and lower semicircular members 39*a* and 39*b* are fit over the suction tube 28, and fastened together around the suction tube 28 by engaging the projection 8 in the recess 37 and tightening the nut 42 on the bolt 41. In this way, the image sensor camera 34 is fixed to the suction tube 28 which is located on the cloth fell's side (front side) of the reed 25. The inward projection 43 of the upper semicircular member 39*a* is snugly received in the slit of the 28*a* of the suction tube 28. The inward projection 43 facilitates and ensures the positioning of the bracket 35 relative to the suction tube 28. The bracket 35 is fixed to the suction tube 28 by the nonpermanent fastener.

It is easy to move the bracket 35 transversely along the suction tube 28. Therefore, the lateral position of the image sensor camera 34 can be readily adjusted by sliding the bracket 35 along the suction tube 28.

The water jet loom shown in FIG. 6 has a splash cover 44 for preventing water from being splashed widely. The cover 44 is movable between an open position and a closed position. The splash cover 44 is formed with an opening 44*a* through which the image sensor camera 34 can view the sensing portion of the weft inserting path.

In the air jet loom having the air guide groove formed in the reed, the image sensor camera is directed to the air guide groove of the reed, as in the first embodiment. In an air jet loom having an air guide distinct from the reed, the image sensor camera should be directed to the air guide. In the water jet loom of the second embodiment, however, there is no guide member for guiding the weft yarn. Therefore, the image sensor camera 34 is aimed at the weft flight path determined by a preliminary examination. The camera is positioned and oriented so that the aiming direction (line) lies in a plane intersecting the flight path of the weft yarn. The cross section of the weft flight path is scanned by the image sensor camera 34 as in the preceding embodiments.

The image sensor camera 34 is connected with a video (image) signal processing circuit (or a computer) similar to the circuit shown in FIG. 3. The image sensor of the second embodiment is also a linear image sensor, and arranged to scan a vertical line lying in the plane intersecting the weft flight path. The weft detecting system of the second embodiment scans the vertical line at the same position two or more times in each pick. During this, the shape of water changes rapidly while the size and position of the flying weft yarn remain almost unchanged. The weft detecting system can accurately discriminate the weft yarn from the water by repeating the scanning cycle a plurality of times in each weft insertion. The weft detecting system of this embodiment can accurately detect the instant of arrival of the weft yarn of each pick. Therefore, it is possible to accurately adjust the amount and timing of water jet ejected from the weft inserting nozzle 23, and to improve the automatic control system of the weaving machine.

When the distance between the image sensor camera and the target of measurement is long, it is optional to employ a telephoto lens as the lens of the image sensor camera of the present invention.

A third embodiment of the present invention is shown in FIGS. 9~13. The weaving machine of the third embodiment is an air jet loom as in the first embodiment. The weft detecting system of the third embodiment is arranged to detect a broken pick as well as the correct arrival of the weft yarn, by monitoring two separate sections of the weft flight path.

Figure 9:
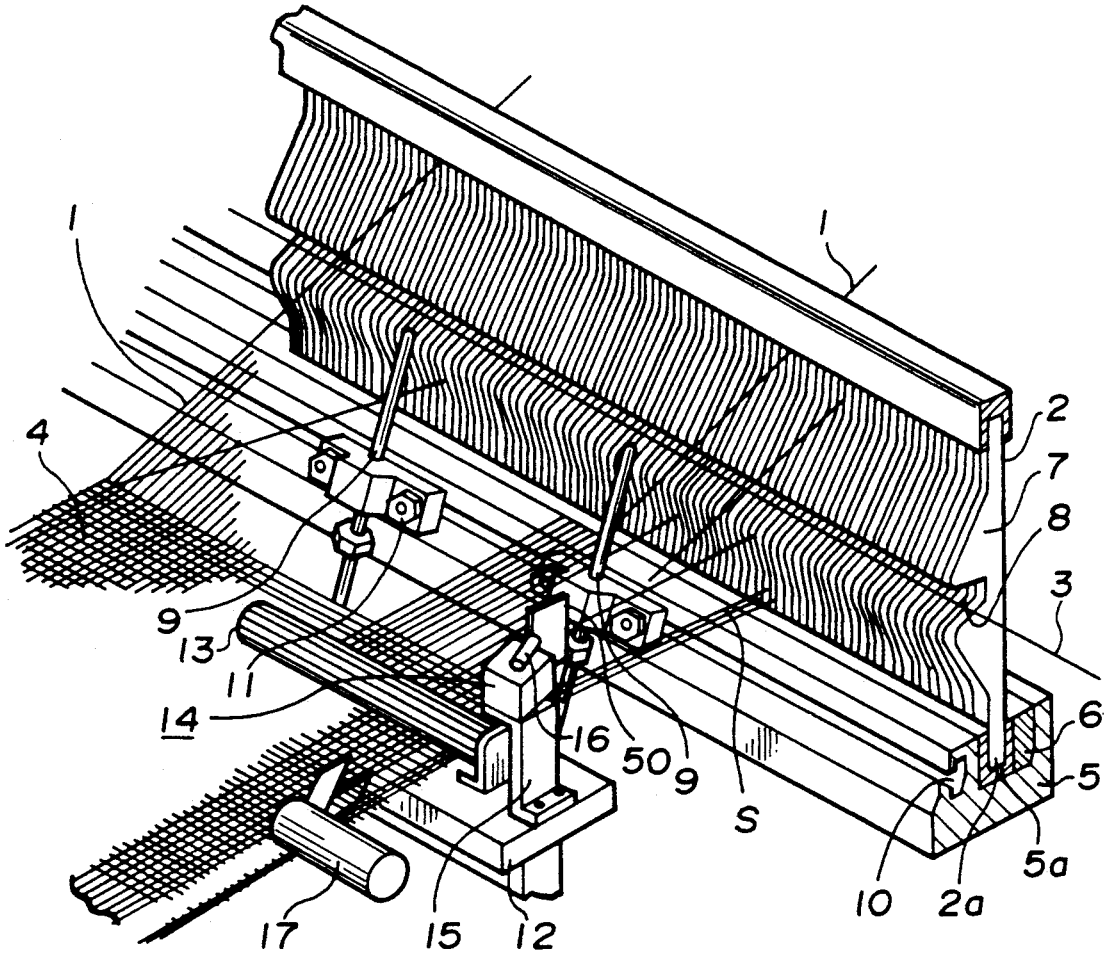
FIG. 9 is a perspective view showing a main portion of an air jet loom according to a third embodiment of the present invention.

Like the air jet loom of FIG. 1, the air jet loom shown in FIG. 9 includes a reed 2 which keeps warp yarns 1 apart and pushes a weft yarn 3 of each pick to a fabric 4, a main air jet nozzle (not shown), and a plurality of auxiliary nozzles 9 mounted on a reed holder 5 in the same manner as the loom of FIG. 1. The weft yarn 3 is ejected from the main nozzle, and moves in a substantially straight path in a weft guide groove 8 formed by reed dents 7 while receiving auxiliary air jets from the auxiliary nozzles 9.

A single image sensor camera 14 is mounted through a mounting stay (or bracket) 15 on a top stay 12 which is fixed to a frame of the weaving machine. The image sensor camera 14 of the third embodiment is also located on the front side of the reed 2 as in the preceding embodiments. The image sensor camera 14 and the cloth fell are located on the same side of the reed 2. The image sensor camera 14 is the same as the camera of the first embodiment.

Figure 10:
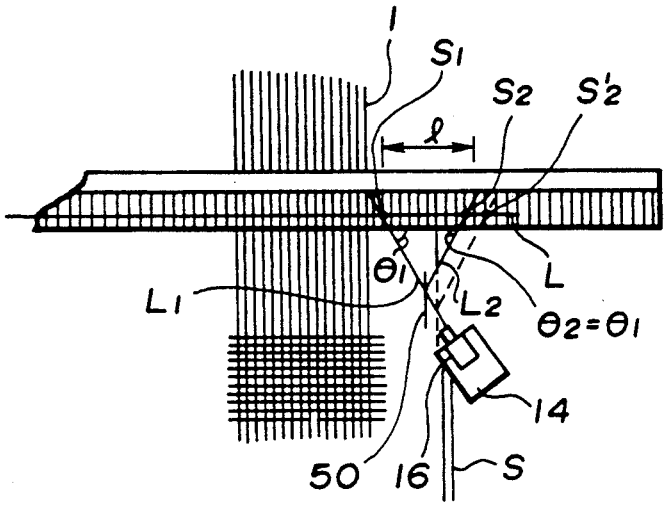
FIG. 10 is a plan view for showing a positional relationship among a half mirror, an image sensor camera and a reed in the air jet loom of FIG. 9.
Figure 11:
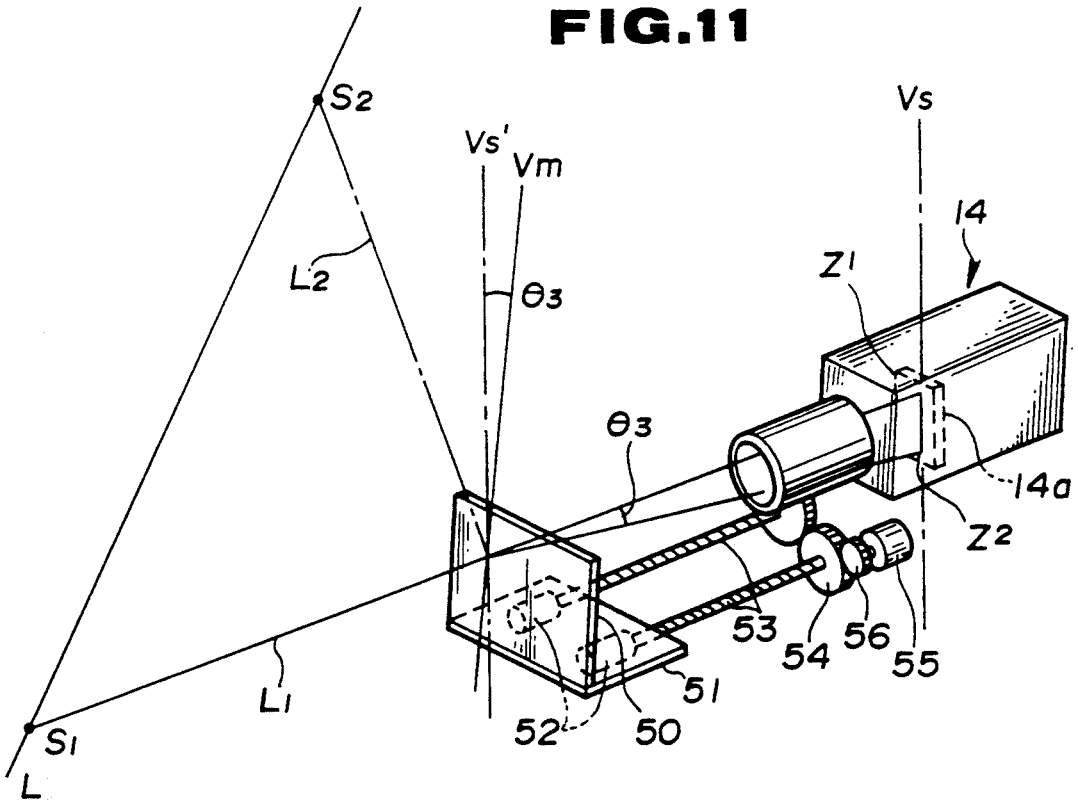
FIG. 11 is a schematic view showing the half mirror and the image sensor camera of the third embodiment.

A half mirror (partially reflecting mirror) 50 is disposed between the image sensor camera 14 and the weft flight path. The half mirror 50 is mounted on the top stay 12 through a drive mechanism. The image sensor camera 14 and the half mirror 50 are positioned and orientated as follows. As shown in FIGS. 10 and 11, a light ray from a first sensing point S1 on the weft flight path L passes through the half mirror 50, and falls on the image sensor 14*a* of the camera 14, and a light ray from a second sensing point S2 on the weft flight path L is reflected by the half mirror 50, and also falls on the image sensor 14*a*. The first and second sensing points (or sections) S1 and S2 both lie on the weft flight path L, and they are separate from each other along the flight path L. The first sensing point S1 is closer to the main air jet nozzle on the picking side of the machine than the second sensing point S2, and the second sensing point S2 is remoter from the main nozzle. Catch cord yarns S extends between the first and second sensing points S1 and S2.

An optical axis of the image sensor camera 14 coincides with an imaginary straight line L1 which intersects, at the first sensing point S1, the straight line L representing the weft flight path at a predetermined angle $\theta 1$. The half mirror 50 is placed at a point of intersection at which the first straight line L1 intersects a second imaginary straight line L2 which intersects the flight path L at the second sensing point S2, and forms a predetermined angle $\theta 2$ ($=\theta 1$) with the flight path L. An incident light ray emanating from the second sensing point S1 is specularly reflected from a reflecting surface of the half mirror 50, and a reflected ray coincides with the optical axis of the lens of the image sensor camera 14.

The half mirror 50 of this embodiment is movable along the optical axis of the image sensor camera 14 so that the separation l between the first and second sensing points S1 and S2 is adjustable in accordance with kinds and conditions of the threads and fabric. When the half mirror 50 is set at a position shown by a broken line in FIG. 10, closer to the camera 14, then the second sensing point is shifted from S2 to S2', and the distance l between the first and second sensing points S1 and S2' is increased. The distance of the folded optical path between the second sensing point S2 and the camera 14 remains equal to the fixed distance of the straight optical path between the first sensing point S1 and the camera 14. The distances of both optical paths are always held equal to each other and fixed at a predetermined constant value while the half mirror 50 is moved along the optical axis of the camera 14. Therefore, it is not necessary to readjust the focal length of the image sensor camera 14. This arrangement eliminates the need for refocusing the optical system of the image sensor camera 14.

Figure 13:
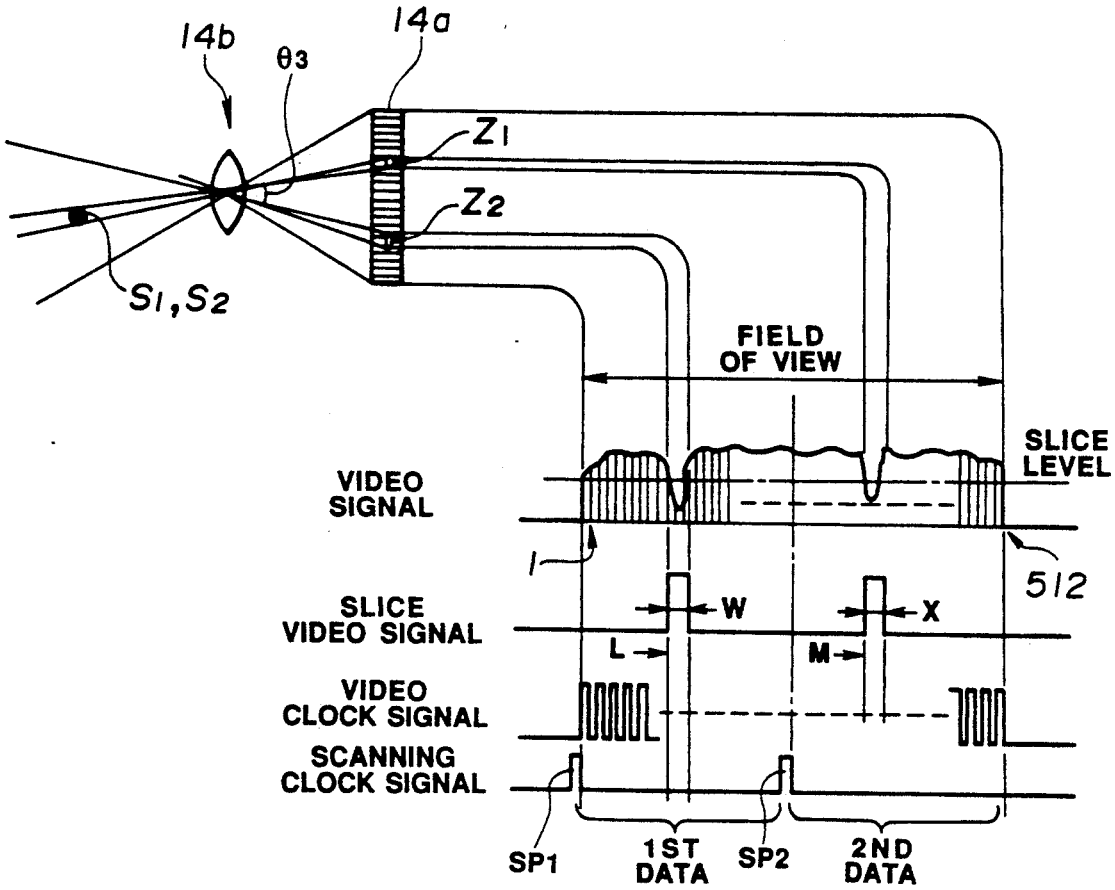
FIG. 13 is a schematic view showing waveforms of signals processed in the circuit of FIG. 12.

As shown in FIG. 11, the mirror surface of the half mirror 50 is inclined with respect to an upright line Vs through an angle $\theta 3$ (line Vm). Therefore, an image Z1 is formed at a first position on the image sensor surface by light rays transmitted from the first sensing point S1 through the half mirror 50, and another image Z2 is formed at a second separate position on the image sensor surface by light rays which extend from the second sensing point S2 and which are reflected from the half mirror 50. Therefore, the single image sensor camera 14 of the third embodiment can monitor the two separate sensing positions at the same time. In the example shown in FIG. 11, the image Z1 of the transmitted rays is formed above the image Z2 of the reflected rays. The image sensor 14*a* produces a video signal as shown in FIG. 13. In FIG. 11, the straight lines Vs and Vm lie on a imaginary vertical plane. The line Vs also lies on the photosensitive surface of the image sensor 14*a*. The line Vm also lies on the mirror surface of the half mirror. A line Vs' is on the imaginary vertical plane, and parallel to the line Vs. The line Vs' intersects the line Vm at a point of reflection shown in FIG. 11. In the imaginary vertical plane, the lines Vm and Vs' forms the angle $\theta 3$.

The drive mechanism of the half mirror 50 is shown in FIG. 11. The half mirror 50 is fixedly mounted on a base plate member 51. Two internally threaded tubular members 52 are fixed to the underside of the base plate member 51. Two externally threaded screw rods 53 extends in parallel to each other. Front ends of the parallel rods 53 are screwed, respectively, in the internally threaded bores of the tubular members 52. A gear 54 is fixedly mounted on a rear end of each of the threaded rods 53. The gears 54 of the two parallel rods 53 are in engagement with each other. A drive gear 56 of a motor 55 is in engagement with one of the gears 53. The motor 55 drives the gears 54 through the drive gear 56, and causes the threaded rods 53 to rotate. As a result, the base plate 51 is moved together with the half mirror 50 along the optical axis of the image sensor camera 14. The screw rods 53 are parallel to the optical axis, and moves the half mirror 50 along the optical axis by being further screwed into the internally threaded members 52 or being rotated in the unscrewed direction. With this arrangement, the single image sensor camera 14 of the third embodiment can accurately detect a broken pick.

The image sensor 14*a* is controlled by a driver (controller) circuit (not shown) in the camera 14. The camera 14 views the weft guide groove 8 of the reed 2 from the front side of the reed 2, and scans the weft guide groove 8 vertically as in the preceding embodiments. Therefore, at least one vertical sectional plane intersecting the weft flight path of the machine is viewed from a predetermined point lying on that sectional plane in front of the reed 2, and scanned up and down. In scanning, the image sensor 14*a* and the optical system are held stationary, but the elemental image signals of the photosensitive elements in the linear array of the image sensor 14*a* are taken out one after another in the order in the array, as in the preceding embodiments.

Figure 12:
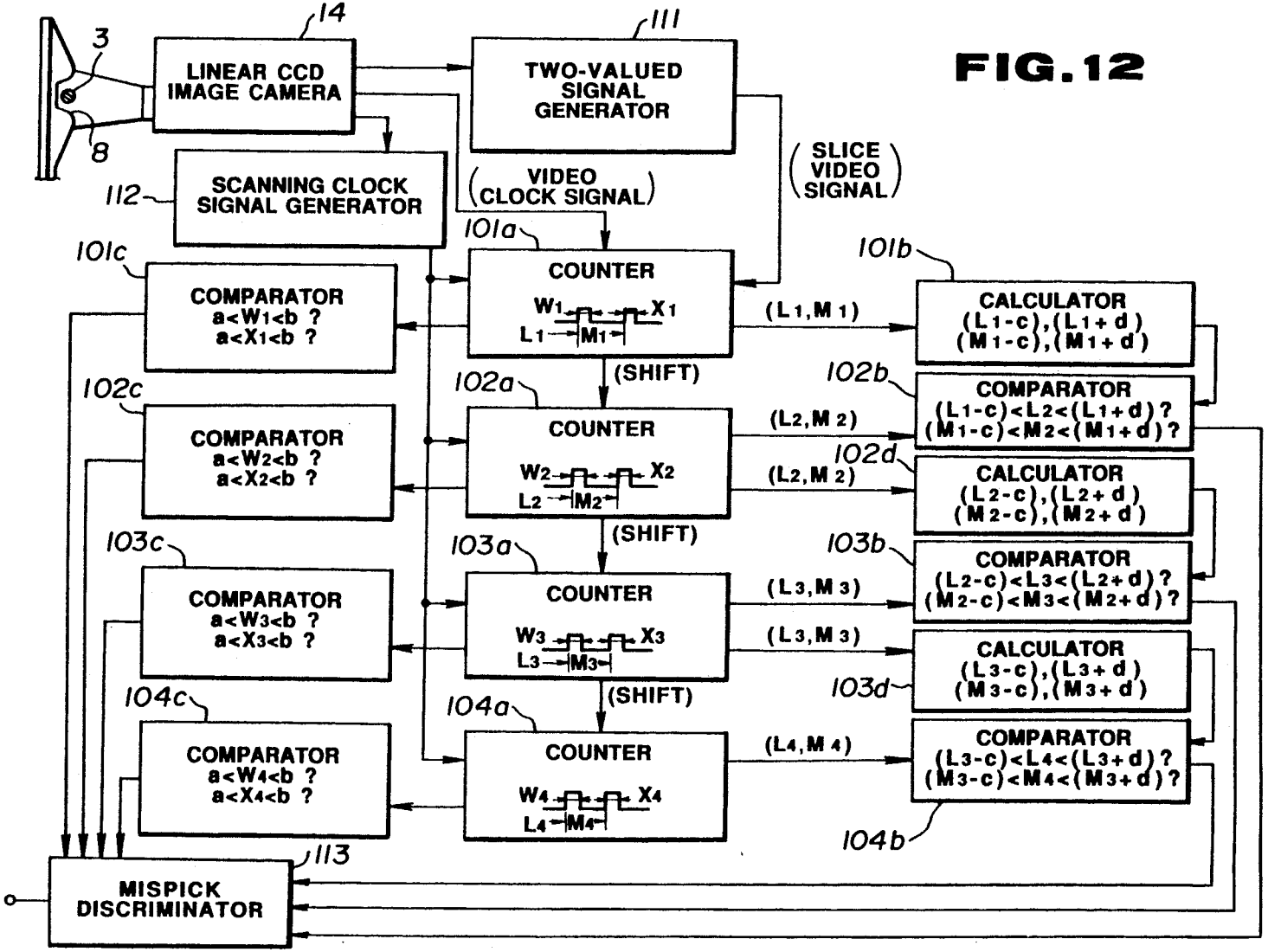
FIG. 12 is a block diagram showing an image processing circuit employed in the third embodiment.

The image sensor 14*a* is connected with a video signal processing circuit shown in FIG. 12. A digital computer can be used as the processing circuit.

Like the processing circuit shown in FIG. 3, the processing circuit shown in FIG. 12 includes a two-valued signal generating circuit 111, an image measuring counter circuit 101*a*, three counter circuits 102*a*, 103*a* and 104*a* for storing old data, four width comparing circuits 101*c*, 102*c*, 103*c* and 104*c*, and circuits 101*b*, 102*b*, 102*d*, 103*b*, 103*d* and 104*b* for monitoring the position of the image.

Unlike the circuit of FIG. 3, the processing circuit of FIG. 12 further includes a pulse generating circuit 112 which receives scan pulses of a scanning clock signal from the image sensor camera 14, and produces two output pulses SP1 and SP2 in response to each scan pulse SP of the camera 14. The first output scan pulse SP1 is the same as the original scan pulse delivered from the camera 14 (or the original scan pulse is allowed to pass through the circuit 112). The second output scan pulse SP2 of the circuit 112 is produced when the middle of the field of view is reached. The second scan pulse SP2 is produced so as to divide the video signal consisting of the elemental signals of the photosensitive elements of the image sensor 14*a* into two halves. The first scan pulse SP1 of the circuit 112 is simultaneous with the scan pulse SP of the camera 14. The second scan pulse SP2 is delayed by a predetermined time interval with respect to the first scan pulse.

In response to each scan pulse SP (=SP1), the image sensor 14*a* initiates the scanning operation, and produces the video signal. The two-valued signal generating circuit 111 receives the video signal from the image sensor camera 14, and produces a slice video signal in the same manner as in the first embodiment shown in FIG. 3. In the example shown in FIG. 13, the slice video signal has two rectangular pulses representing the weft yarn. The first rectangular pulse corresponds to the image Z2 of the second sensing point S2, and the second rectangular pulse corresponds to the image Z1 of the first sensing point S1. In the case of a broken pick, the image sensor 14*a* detects the weft yarn at the first and second sensing points S1 and S2 within the same scanning cycle as in the example of FIG. 13.

The measuring counter circuit 101*a* determines the leading edge position L and the width W of the first rectangular pulse, and the leading edge position M and the width X of the second rectangular pulse. In this embodiment, the counter circuit 101*a* receives the clock signal from the camera 14, and the scan pulses from the pulse generating circuit 112. When the first scan pulse SP1 is produced, the image measuring counter circuit 101*a* determines L and W by counting the clock pulses. Similarly, M and X are determined by count of the clock pulses when the second scan pulse SP2 is produced.

The counter circuits 101*a*~104*a* are connected in series. As in the processing circuit of FIG. 3, the first date set of the items L and W is shifted from each of the counter circuits 101*a*~103*a* to the next counter circuit each time the first scan pulse SP1 is produced. The second date set of the items M and X is shifted from each of the first three counter circuits to the next counter circuit each time the second scan pulse SP2 is produced. Therefore, the last counter circuit 104*a* stores the results L4, W4, M4 and X4 of a scanning cycle performed a while ago, the counter circuit 103*a* stores the results L3, W3, M3 and X3 of the next scanning cycle. The results of the most recent scanning operation are stored in the counter circuit 101*a*.

The width comparator circuits 101*c*~104*c* are connected, respectively, with the counter circuits 101*a*~104*a*. The first comparator circuit 101*c* receives the width data items W1 and X1 from the counter circuit 101*a*, and compares the widths W1 and X1 with a predetermined smaller constant a and a predetermined greater constant b. Thus, the first width comparator circuit 101*c* determines whether $a<W1<b$, or not, and further determines whether $a<X1<b$, or not. The results are delivered from the comparator circuit 101*c* to a mispick discriminating circuit 113. In the same manner, each of W2, X2, W3, X3 and W4 and X4 is checked to determine whether the measured width of the image is in the predetermined range between a and b.

The calculator circuits 101*b*, 102*d*, 103*d* are connected, respectively, with the counter circuits 101*a*, 102*a* and 103*a*. A predetermined constant c is subtracted from, and a predetermined constant d is added to each of L1, M1, L2, M2, L3 and M3.

The position comparator circuits 102*b*, 103*b* and 104*b* are connected, respectively, with the counter circuits 102*a*, 103*a* and 104*a*. The comparator circuit 102*b* determines whether $(L1-c)<L2<(L1+d)$, or not, and further determines whether $(M1-c)<M2<(M1+d)$, or not. Similarly, the comparator circuit 103*b* checks L3 and M3, and the comparator circuit 104*b* checks L4 and M4. Output signals of the comparator circuits 102*b*, 103*b* and 104*b* are delivered to the mispick discriminating circuit 113.

The mispick discriminating circuit 113 discriminates short pick, broken pick and normal pick from the signals from the comparating circuits. If a weft yarn fails to reach the correct position on the arrival (anti-nozzle) side of the machine as in the short pick, then the weft yarn is detected neither at the first sensing position S1 nor at the second sensing position S2. If a weft yarn is broken on the way of weft insertion, then the image sensor 14*a* can detect the weft yarn both at the first and second sensing points S1 and S2. When the weft insertion is correct and normal, the weft yarn of each pick passes through the first sensing position S1, but it does not reach the second sensing position S2.

A spot lamp 16 is mounted on the image sensor camera 14 as shown in FIG. 9. The spot lamp 16 projects a light beam toward the first sensing point S1 through the half mirror 50. Part of the light beam transmits through the half mirror 50, and part of the beam 16 is reflected by the half mirror so that the second sensing point S2 is also illuminated. In the third embodiment, too, it is possible to employ the optical fibers 60 and the light source 61 shown in FIGS. 8A and 8B.

Figure 14:
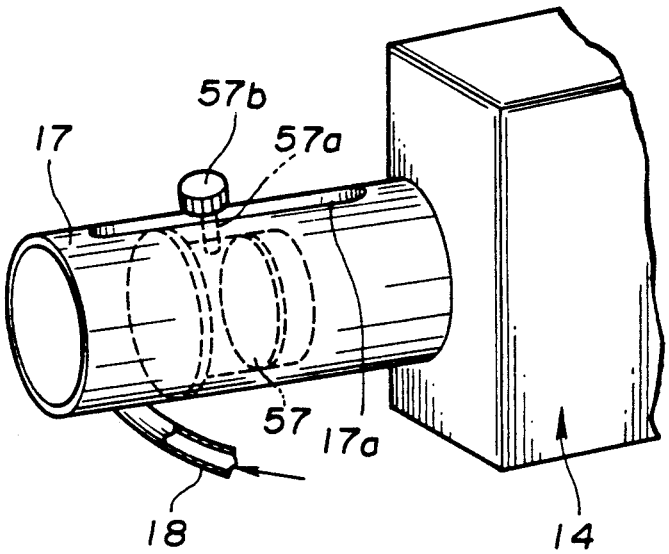
FIG. 14 is a perspective view showing a hood which can be employed in the third embodiment.

It is possible to enclose the half mirror 50 and the lens of the camera 14 in a single hood, and to supply purge air into the hood to blow off cotton fly and dust from the half mirror and lens. FIG. 14 shows one example. An inner cylindrical member 57 is slidably received in a lens hood 17. A half mirror is fixed to the inner cylindrical member 57. The lens hood 17 has a slot 17*a* extending in parallel to the optical axis of the image sensor camera 14. A stud 57*a* fixed to the inner cylindrical member 57 is slidably received in the slot 17*a*. A knob 57*b* is formed at the top of the stud 57*a*. The stud 57*a* facilitates the axial movement of the inner cylindrical member 57 supporting the half mirror, and prevent rotational movement of the inner member 57. A pipe 18 is connected with the hood 17, and air is supplied into the hood 17 to protect the half mirror and lens simultaneously. Therefore, both of the half mirror and the camera lens are protected by a single common air supplying system.

Figure 15:
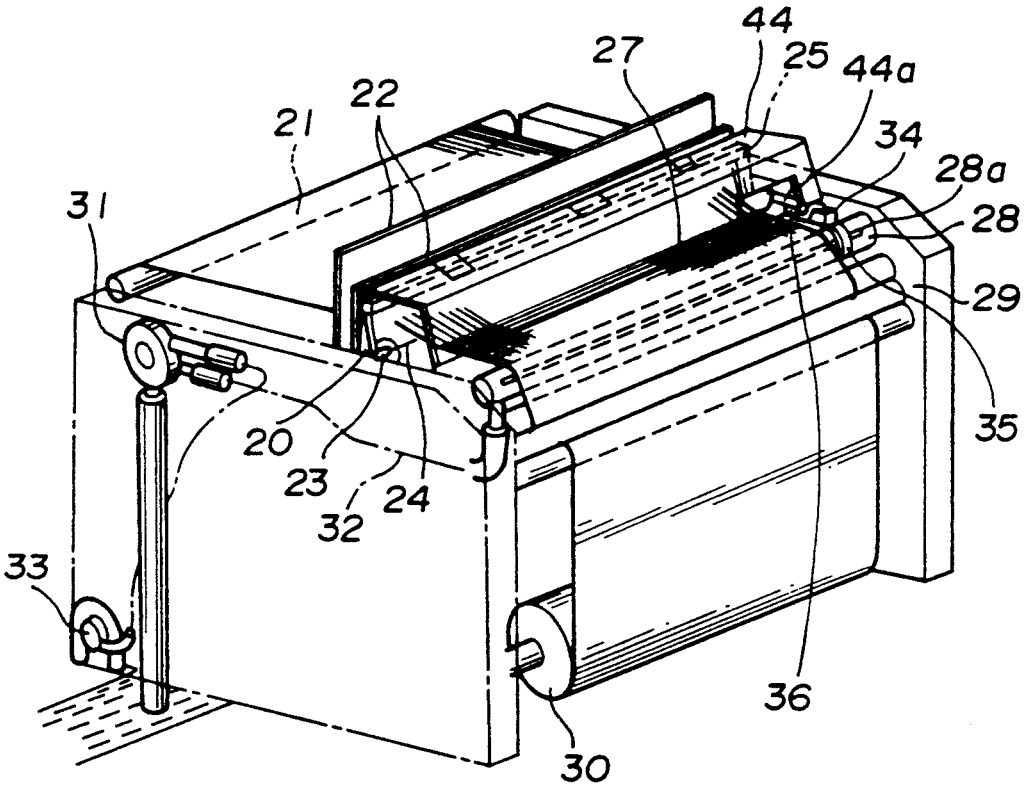
FIG. 15 is a perspective view showing a water jet loom according to a fourth embodiment of the present invention.

A fourth embodiment of the present invention is shown in FIG. 15. The weaving machine of the fourth embodiment is a water jet loom as in the second embodiment, and is equipped with a half mirror as in the third embodiment.

The water jet loom shown in FIG. 15 is almost the same as the water jet loom shown in FIG. 6. A suction cylindrical tube 28 for removing water from a woven fabric 28 extends transversely in front of a reed 25 like the loom of FIG. 6.

A half mirror 36 is mounted on the suction tube 28 through a drive mechanism similar to the drive mechanism shown in FIG. 11. The half mirror 36 is positioned and oriented, substantially in the same manner as shown in FIGS. 10 and 11, between the reed 25 and an image sensor camera 34 which is also mounted on the suction tube 28.

The image sensor camera 14 has a linear CCD image sensor 14*a*, and is connected with a video signal processing circuit similar to the circuit shown in FIG. 12.

The weft detecting system of the fourth embodiment can discriminate the weft yarn from water as in the second embodiment, and detect broken picks as in the third embodiment.

The optical system including the half mirror is applicable to a weft detecting system which does not employ the image sensor. It is possible to monitor two separate sensing points by using the half mirror, and a conventional sensor used in a conventional weft feeler.

Figure 16:
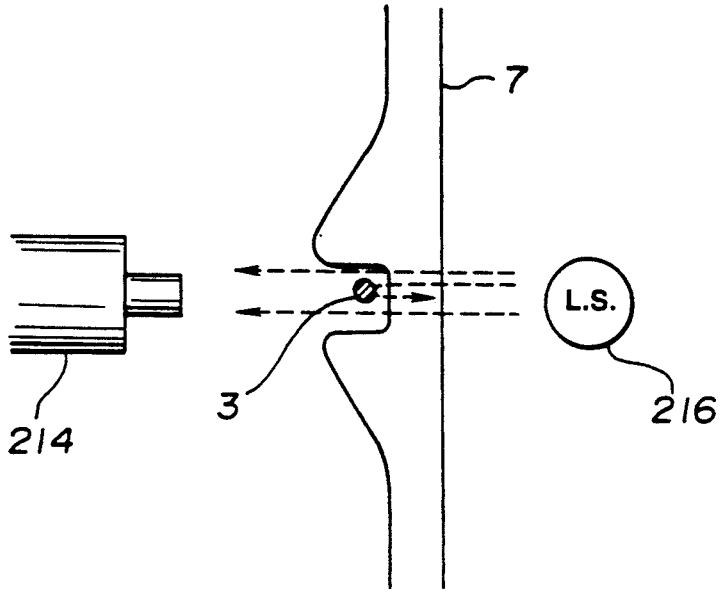
FIG. 16 is a side view schematically showing a fifth embodiment in which a light source is placed behind a reed.

A fifth embodiment of the present invention is shown in FIG. 16. In this embodiment, an image sensor camera 214 is placed on the front side of the reed, and a light source 216 is placed on the back side of the reed. In the example shown in FIG. 16, the reed has reed dents 7 formed with recesses for defining the weft flight path as in the first and third embodiments. In this arrangement, light of the light source 216 is reflected back by the weft yarn 3. As viewed by the front side camera 214, the weft yarn 3 is dark in the bright surrounding. In this example, the backside light source 216 is fixedly mounted on the reed. The arrangement of the fifth embodiment is applicable to not only air jet looms but also water jet looms.

Figure 17:
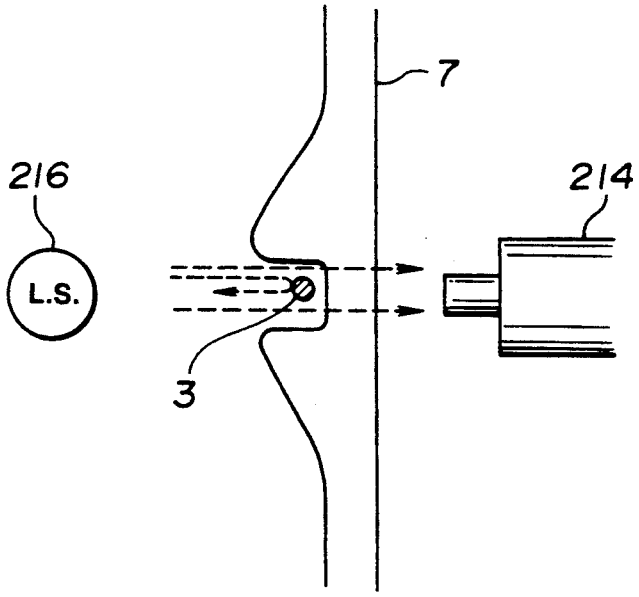
FIG. 17 is a side view schematically showing a sixth embodiment in which an image sensor camera is placed behind a reed.

A sixth embodiment of the present invention is shown in FIG. 17. In this embodiment, a light source 216 is placed on the front side of the reed, and an image sensor camera 214 is placed on the back side of the reed. In this example, the back side image sensor camera 214 is fixedly mounted on the reed. This arrangement is also applicable to air jet looms and water jet looms.

Figure 18C:
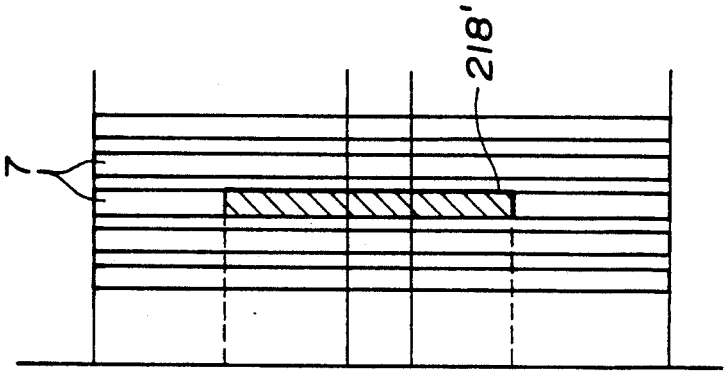
FIG. 18C is a front view similar to FIG. 18B, but showing a variation of the large screen.
Figure 18B:
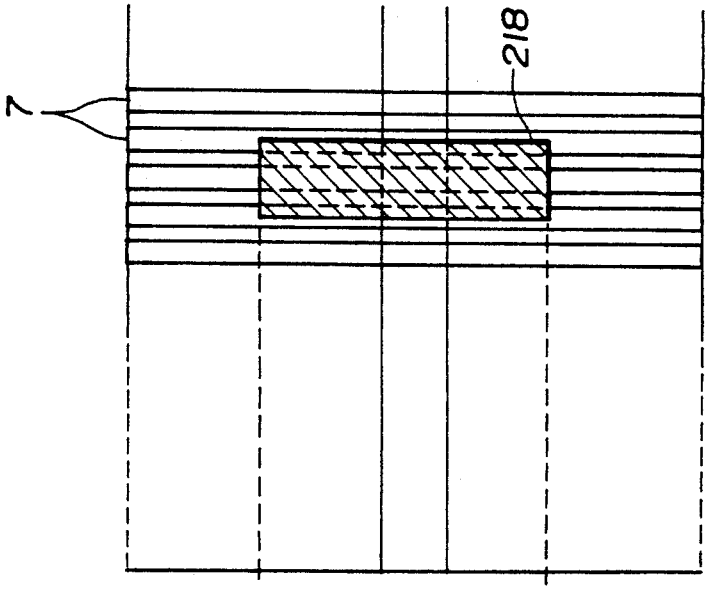
FIGS. 18A and 18B show a seventh embodiment which employs a large screen and upper and lower light sources.
Figure 18A:
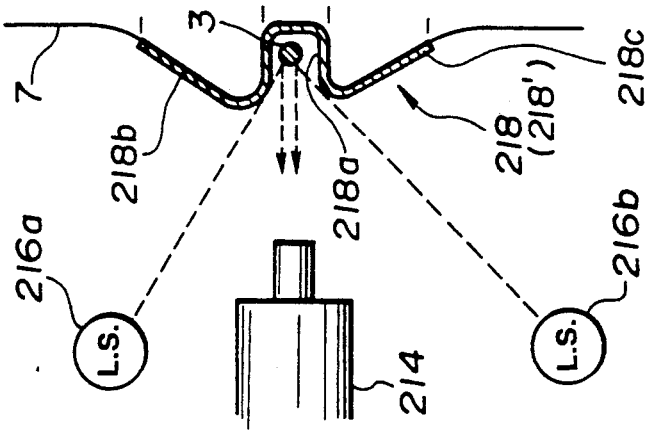

A seventh embodiment of the present invention is shown in FIGS. 18A and 18B. In this embodiment, upper and lower light sources 216*a* and 216*b* are placed on the front side of the reed, and a screen 218 is attached to the reed 2. An image sensor camera 214 is also placed on the front side of the reed 2. In this embodiment, the light sources 216*a* and 216*b* and the image sensor camera 214 are all mounted on the frame of the weaving machine through brackets, so that they are stationary. The upper light source 216*a* is located above the image sensor camera 214, and the lower light source 216*b* is below the camera 214. Light rays from the upper and lower light sources 216*a* and 216*b* are reflected by the weft yarn 3 flying in the weft flight path within the weft guide groove formed in the reed dents 7, and reflected rays fall on the image sensor in the camera 214.

As shown in FIG. 18A, the screen 218 is fixed to front faces of predetermined reed dents 7. The bottom and side walls of a predetermined portion of the weft guide groove 8 formed in the reed dents 7 are covered with the screen 218. As shown in FIG. 18A, the screen 218 has a U-shaped portion 218*a* which is tightly fit in the U-shaped weft guide groove 8, an upper portion 218*b* extending upwardly from an upper end of the U-shaped portion, and a lower portion 218*c* extending downwardly from a lower end of the U-shaped portion. As shown in FIG. 18B, the screen 218 of this example extends laterally over three reed dents 7 and two interspaces among these reed dents.

The screen 218 serves as a background for making the weft yarn more conspicuous. The screen 218 forms a sharper contrast between the weft yarn 3 and the background. In the example shown in FIG. 18A and 18B, the weft yarn 3 is made bright and the screen 218 is made dark. The material and color of the screen 218 are chosen so that the weft yarn is well contrasted by the screen 218.

It is optional to employ only one of the upper and lower light sources 216*a* and 216*b* and to eliminate the other.

FIG. 18C shows a variation of the screen. The screen 218′ shown in FIG. 18C is narrower than the screen 218 of FIG. 18B. The narrow screen 218′ is attached to only one reed dent 7. The width of the narrow screen 218′ is substantially equal to the width of the reed dent 7. The narrow screen 218′ has the same sectional shape as the wide screen 218 as shown in FIG. 18A.

Figure 19C:
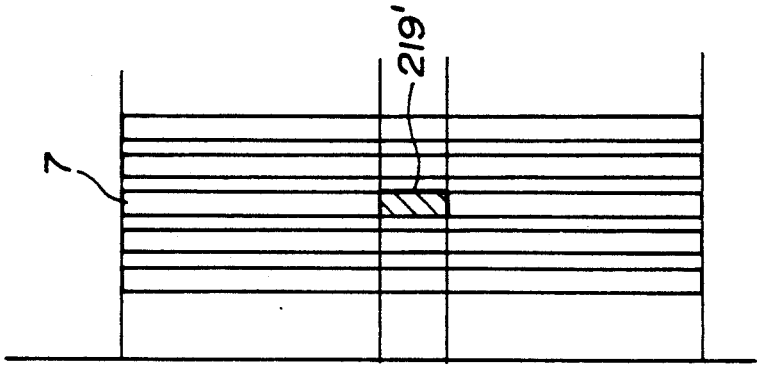
FIG. 19C is a front view showing a variation of the small screen.
Figure 19B:
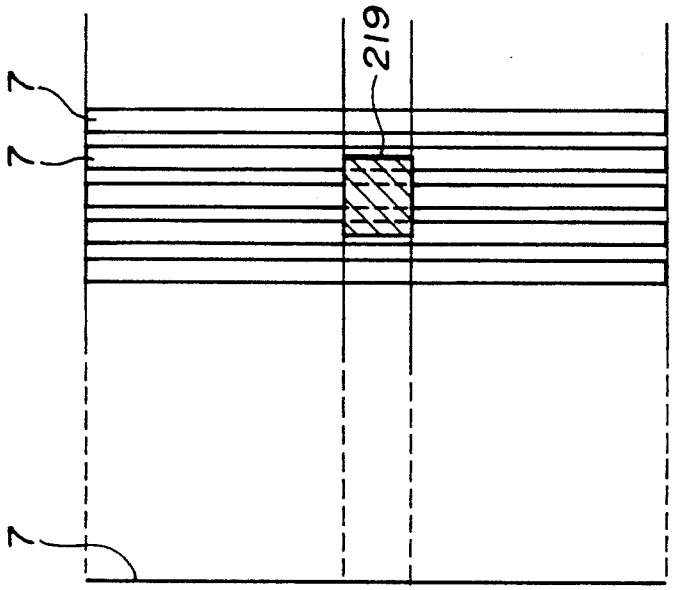
FIGS. 19A and 19B are side view and front view for showing an eighth embodiment which employs upper and lower light sources mounted on a reed, and a small screen.
Figure 19A:
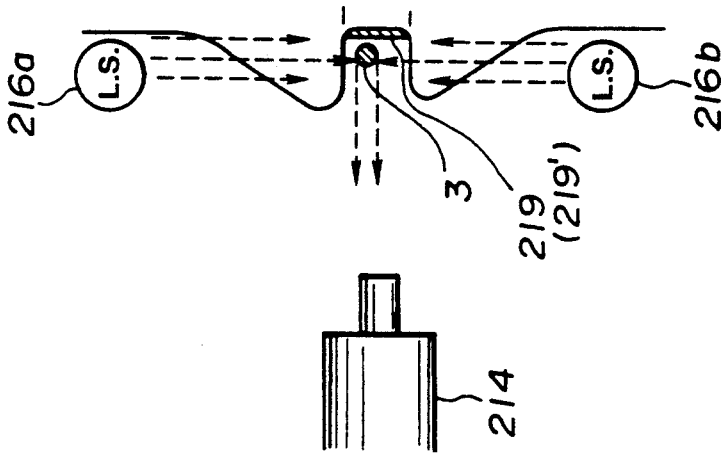

An eighth embodiment of the present invention is shown in FIG. 19A and 19B. In this embodiment, there are provided a front side image sensor camera 214, upper and lower front side light sources 216*a* and 216*b*, and a small screen 219.

The image sensor camera 214 is placed on the front side of the reed 2, and mounted on a front side stationary member of the weaving machine. The upper and lower light sources 216*a* and 216*b* of this embodiment are mounted on the reed 2. The upper light source 216*a* is above the weft guide groove 8, and the lower light source 216*b* is below the weft guide groove 8. The camera 214 and the weft guide groove 8 are located at a level between the upper and lower light sources 216*a* and 216*b*. From the upper and lower light sources 216*a* and 216*b*, light rays extend vertically in one or more interspaces between two or more reed dents, and illuminate the weft yarn 3.

The screen 219 is attached to the bottom of the weft guide groove 8 formed in the reed dents 7. The screen 219 is small, and covers only the bottom of the weft guide groove 8. The upper and lower side walls of the weft guide groove 8 are not covered with the screen 219. As shown in FIG. 19B, the small screen 219 extends laterally over three reed dents and two interspaces like the wide and large screen 218 shown in FIG. 18B. The screen 219 forms a sharp contrast between the weft yarn 3 and the background. It is optional to employ only one of the upper and lower light sources 216*a* and 216*b* shown in FIG. 19A, and to eliminate the other.

A screen 219′ shown in FIG. 19C is narrower than the small screen 219 of FIG. 19B. The small and narrow screen 219 is attached to only one reed dent 7, and has a width substantially equal to the width of the reed dent 7.

In the present invention, it is optional to employ a shading means, such as a lamp shade or a louver, which is placed between a light source and a weft insertion path, for allowing only a desired portion to be illuminated by the light source, and shading the surroundings.

What is claimed is:

1. A weft inserting and beating system for a weaving machine, comprising:

an image sensor for detecting a weft yarn at a predetermined position in said weft inserting and beating system;

means for aiming said image sensor at a weft insertion path of said weft inserting and beating system along which the weft yarn moves; and means for causing said image sensor to scan along a direction intersecting said weft insertion path.

2. A weft inserting and beating system according to claim 1 wherein said weft inserting and beating system further comprises a fluid jet means for producing a fluid jet to carry the weft yarn through a warp shed along said weft inserting path which is separate from a position of a cloth fell, and wherein said image sensor is located on a cloth fell's side of said weft insertion path.

3. A weft inserting and beating system according to claim 2 further comprising a lighting apparatus placed at one of an upper position above said weft insertion path, and a lower position below said weft insertion path.

4. A weft inserting and beating system according to claim 3 further comprising a reed, and a screen for forming a contrast to the weft yarn, said screen being attached to the reed at such a position that an image of the weft yarn formed on said image sensor is better contrasted by a background formed by said screen.

5. A weft inserting and beating system according to claim 2 wherein said fluid jet means comprises an air jet and wherein a reed has a weft guide passage formed in said reed, and said image sensor is aimed at said weft guide passage so that said image sensor scans across said weft guide passage.

6. A weft inserting and beating system according to claim 2 further comprising a half mirror positioned between said weft insertion path and said image sensor, and oriented so that an image of the weft yarn is formed on said image sensor by light rays transmitted through said half mirror, and another image of the weft yarn is formed on said image sensor by light rays reflected by said half mirror.

7. A weft inserting and beating system according to claim 2 wherein said fluid jet means comprises a water jet, and wherein said image sensor includes a means for performing a plurality of scans in a single pick, and producing an image signal representing an image of the weft yarn in each scan, and said weft inserting and beating system further comprises an image signal processing means for receiving said image signals and discriminating the weft yarn from water by examining said image signals.

8. A weft inserting and beating system according to claim 7 wherein said image sensor is mounted on a suction tube for removing water from a woven fabric.

9. A weft inserting and beating system according to claim 7 further comprising an optical system for forming an image of the weft yarn on said image sensor, and a hood for enclosing and protecting said optical system, said hood being connected with a means for supplying air into said hood.

10. A weft inserting and beating system according to claim 1 wherein said image sensor includes a means for performing a plurality of scans in a single pick, and producing an image signal representing an image of the weft yarn in each scan, and said weft sensing system further comprises an image signal processing means for comparing said image signals.

11. A weft inserting and beating system according to claim 1 wherein said image sensor includes a means for performing a single scan in each pick and producing an image signal representing an image of the weft yarn in each pick, and said weft sensing system further comprises an image signal processing means for comparing said image signals.

12. A weft inserting and beating system according to claim 1 wherein said image sensor is a solid-state image sensor for detecting the weft yarn moving along said weft insertion path.

13. A weft inserting and beating system according to claim 1 wherein said image sensor is one of a CCD image sensor and a MOS type image sensor.

14. A weft inserting and beating system according to claim 13 wherein said weft inserting beating system further comprises a fluid jet means for producing a fluid jet to carry the weft yarn, and a reed, and wherein said image sensor is located on a cloth fell's side of said reed.

15. A weft inserting and beating system according to claim 1, wherein said aiming means comprises an optical means for forming an image of the weft yarn flying through a warp shed along said weft insertion path which is separate from a position of a cloth fell, and said system further comprises a processing means for processing an output signal from said image sensor while a normal weft inserting operation is being performed, and for producing a stop signal to stop the normal weft inserting operation when an abnormal weft insertion is detected.

16. A weft inserting and beating system according to claim 1, wherein said aiming means comprises an optical means for enabling said image sensor to scan along said direction intersecting said weft insertion path, said direction being substantially vertical and substantially perpendicular to a direction along which warp yarns advance.

17. A weaving machine comprising:

an image sensor comprising an array of solid-state photosensitive elements;

an optical means for forming an image of a weft yarn moving along a weft insertion path in the weaving machine, on said image sensor; and a processing means for processing an output signal of said image sensor to detect an abnormal weft insertion during a normal weaving operation of said weaving machine.

18. A weaving machine according to claim 17 wherein said optical means comprises a lens, adopted to be aimed at said weft insertion path so that said weft insertion path is viewed from a predetermined aiming direction lying in a predetermined first imaginary plane which intersects said weft insertion path.

19. A weaving machine according to claim 17 further comprising a means for positioning and orienting said image sensor and said optical means so as to measure a size of the weft yarn moving along said weft insertion path which is separate from a position of a cloth fell.

20. A weaving machine according to claim 18 wherein said weaving machine comprises a reed, and said image sensor is one of a linear image sensor and an area image sensor, said image sensor being located on a cloth fell's side of said reed so that a cloth fell is formed on the same side of said reed as said image sensor.

21. A weaving machine according to claim 18 wherein said weaving machine comprises a reed, and a front side stationary member which is stationary and located on a cloth fell's side of said reed so that warp yarns advance from said reed toward said front side stationary member in a normal weaving operation, and wherein said image sensor and said optical means are enclosed in a camera casing, and mounted on said front side stationary member.

22. A weaving machine according to claim 21 wherein said array of said photosensitive elements comprises a linear array of said photosensitive elements which are arranged in a straight line, and said optical means is oriented so that an optical axis of said optical means intersects said weft insertion path, and lies in said first imaginary plane intersecting said weft insertion path, and that said optical means forms, on said linear array, an image of a vertical straight line segment which lies in said first imaginary plane and which intersects said weft insertion path.

23. A weaving machine according to claim 21 wherein said weaving machine further comprises a half mirror which enables said optical means to view a first sensing point on said weft insertion path by allowing a light ray to be transmitted from said first sensing point through said half mirror to said optical means, and which further enables said optical means to view a second sensing position separate from said first sensing position along said weft insertion path by reflecting a light ray from said second sensing position.

24. A weaving machine according to claim 23 wherein said half mirror is mounted on a mirror mount for adjusting a position of said half mirror along said optical axis of said optical means.

25. A weaving machine according to claim 23 wherein said half mirror is inclined so that images of said first and second sensing points are formed at separate points on said image sensor.

26. A weaving machine according to claim 22 wherein said first imaginary plane is substantially perpendicular to said weft insertion path.

27. A weaving machine according to claim 22 further comprises a means for illuminating a predetermined portion of said weft insertion path.

28. A weaving machine according to claim 27 wherein said illuminating means comprises a front side light source which is placed, on the cloth fell's side of said reed, at a level which is vertically separated from a level at which said weft insertion path lies.

29. A weaving machine according to claim 28 wherein said weaving machine comprises a screen for forming a contrast to the weft yarn in said weft insertion path, said screen being attached to said reed, and viewed as a background through said optical means.

30. A weaving machine according to claim 20 wherein said image sensor produces an image signal representing an image of the weft yarn in each of a plurality of scans, and said processing means includes a means for determining a thread size of the weft yarn from said image signal, and determining whether said thread size is within a predetermined size range.

31. A weaving machine according to claim 30 wherein said processing means comprises a storage means for storing values of said thread size which have been determined from a plurality of said image signals consecutively produced by said image sensor, and a size monitoring means for producing a first alarm signal when at least one of said values of said thread size stored in said storage means is out of said predetermined size range.

32. A weaving machine according to claim 31 wherein said image sensor is connected with a sensor drive means for causing said image sensor to perform a single scan in each pick.

33. A weaving machine according to claim 31 wherein said image sensor is connected with a sensor drive means for causing said image sensor to perform a plurality of scans in each pick.

34. A weaving machine according to claim 33 wherein said processing means comprises a measuring means for determining a thread position of the weft yarn, as well as said thread size, from each of said image signals, and a position monitoring means for producing a second alarm signal if said thread position changes beyond a predetermined extent between two consecutive scans.

35. A weaving machine according to claim 34 wherein said weaving machine is a water jet loom, and comprises a water jet nozzle for weft insertion, and a front side suction tube for removing water from a woven fabric, and said image sensor and said optical means are mounted on said front side suction tube.

36. A weaving machine according to claim 35 wherein said suction tube extends substantially in parallel to said weft insertion path, and has a slot extending substantially in parallel to said weft insertion path, and said image sensor and said optical means are mounted on a bracket which is fastened to said suction tube by a nonpermanent fastener, said bracket comprising a projection which is slidably received in said slot.

37. A weaving machine according to claim 35 wherein said optical means is enclosed in a lens hood, which is connected with a means for suppying air into said lens hood.

38. A weaving machine according to claim 18 wherein said weaving machine is an air jet loom, and comprises a reed comprising a plurality of profiled reed dents each of which is formed with a recess, said recesses of said reed dents being aligned so as to form a weft guide groove extending along said weft insertion path, and wherein said optical means is aimed at a predetermined section of said weft guide groove 39. A weaving machine according to claim 38 wherein said reed comprises a special reed dent in which at least one optical fiber is embedded for transmitting light to said weft guide groove.

40. A weaving machine according to claim 18 wherein said weaving machine comprises a reed, and a light source for illuminating a predetermined portion of said weft insertion path, said reed being located between said image sensor and said light source 41. A weaving machine according to claim 40 wherein said image sensor and said optical means are located on a front side of said reed, and said light source is located on a back side of said reed.

42. A weaving machine according to claim 40 wherein said image sensor and said optical means are located on a back side of said reed, and said light source is located on a front side of said reed.

43. A weaving machine according to claim 18 wherein said weaving machine comprises a reed, which is opposite to a cloth fell's side of said reed and said image sensor is placed on a back side of said reed.

44. A weaving machine according to claim 18, further comprising a means for supporting said image sensor and said optical means, and determining positions and directions of said image sensor and said optical means such that an image of a predetermined sensing position on said weft insertion path is formed on said image sensor, said sensing position being located on one side of a collection of warp yarns mounted on said weaving machine so that all the warp yarns to be woven into a fabric are located only on one side of said sensing position.

45. A weaving machine according to claim 17 wherein said image sensor is one of a CCD image sensor and a MOS type image sensor.

46. A method of detecting a weft yarn in a weft inserting system of weaving machine, comprising the steps of:

aiming an image sensor at a weft insertion path into which said weft yarn is inserted;

scanning said weft insertion path with said image sensor during a weft inserting operation of said weft inserting system; and detecting with said image sensor said weft yarn at a predetermined position in said weft inserting system as it is being inserted.

47. A weaving machine according to claim 17, wherein said weaving machine further comprises a means for driving said image sensor during the normal weaving operation of the weaving machine, and causing said image sensor to monitor weft insertion during the normal weaving operation, and wherein said processing means includes a means for processing the output signal of the image sensor during the normal weaving operation, and producing a stop signal to stop the normal weaving operation when the abnormal weft insertion is detected.

* * * * *